US010132217B2

(12) United States Patent
Lawrence et al.

(10) Patent No.: US 10,132,217 B2
(45) Date of Patent: Nov. 20, 2018

(54) FLOATING CRANKCASE VENTILATION SYSTEM AND METHOD

(71) Applicant: Caterpillar Inc., Peoria, IL (US)

(72) Inventors: Rodney A. Lawrence, Peoria, IL (US); Brandyn A. Stack, Peoria, IL (US); Eric Ferguson, Peoria, IL (US)

(73) Assignee: Caterpillar Inc., Deerfield, IL (US)

( * ) Notice: Subject to any disclaimer, the term of this patent is extended or adjusted under 35 U.S.C. 154(b) by 415 days.

(21) Appl. No.: 15/079,990

(22) Filed: Mar. 24, 2016

(65) Prior Publication Data

US 2017/0276040 A1 Sep. 28, 2017

(51) Int. Cl.
*F01M 13/04* (2006.01)
*F01M 11/00* (2006.01)

(52) U.S. Cl.
CPC ..... *F01M 13/04* (2013.01); *F01M 11/0004* (2013.01); *F01M 2013/0433* (2013.01); *F01M 2013/0438* (2013.01); *F01M 2013/0472* (2013.01)

(58) Field of Classification Search
CPC ..... F01M 13/04; F01M 11/0004; F01M 2013/0472; F01M 2013/0438; F01M 2013/0433; F02M 35/10222
See application file for complete search history.

(56) References Cited

U.S. PATENT DOCUMENTS

| | | | | |
|---|---|---|---|---|
| 6,354,283 | B1 | 3/2002 | Hawkins et al. | |
| 6,647,973 | B1 * | 11/2003 | Schueler | F01M 13/04 123/572 |
| 6,811,586 | B2 | 11/2004 | Stegmaier et al. | |
| 7,740,677 | B2 | 6/2010 | Knittel et al. | |
| 7,870,850 | B2 * | 1/2011 | Herman | F01M 13/04 123/572 |
| 8,156,926 | B2 | 4/2012 | Weber et al. | |
| 8,210,135 | B2 * | 7/2012 | Slaughter | F01M 13/04 123/41.86 |
| 9,267,404 | B2 * | 2/2016 | Shin | F01M 13/028 |
| 2002/0088445 | A1 * | 7/2002 | Weindorf | B04B 5/005 123/572 |
| 2014/0014080 | A1 * | 1/2014 | Beshay | F01M 13/022 123/574 |
| 2014/0290634 | A1 | 10/2014 | Slaughter et al. | |
| 2014/0298800 | A1 * | 10/2014 | Bidner | F02B 37/183 60/602 |
| 2016/0097308 | A1 * | 4/2016 | Rexavier | F01M 13/04 60/598 |

* cited by examiner

*Primary Examiner* — Grant Moubry
(74) *Attorney, Agent, or Firm* — Leydig, Voit & Mayer, Ltd.

(57) ABSTRACT

An internal combustion engine includes a crankcase having first and second pluralities of openings. A oil separation module has at least one inlet housing that communicates with a oil separation filter and is connectable to at least one opening from the first plurality of openings or from the second plurality of openings to define a crankcase vent.

20 Claims, 4 Drawing Sheets

FLOATING CRANKCASE VENTILATION SYSTEM AND METHOD

TECHNICAL FIELD

This patent disclosure relates generally to a crankcase ventilation systems and, more particularly, to a filtered crankcase ventilation system for an internal combustion engine.

BACKGROUND

Typical internal combustion engines operate by introducing fuel and air into cylinders for combustion. The pistons move within the cylinders to compress the fuel and air mixture, which combusts. The burning fuel expands the air volume in the cylinder producing power. A sliding seal between each piston and the respective bore in which the piston is operating helps seal the compressing fuel and air mixture, and also seals combustion products in the cylinder as the volume expands and pressure in the cylinder increases. Exhaust products, however, may leak past the piston seals and enter an interior volume of the crankcase. Exhaust products may also enter internal engine cavities though intake or exhaust valve seals, turbocharger cooling oil streams and, possibly, other sources. These combustion products are sometimes referred to as "blow-by gases" or "blow-by." Blow-by gases contain contaminants normally found in exhaust gases such as hydrocarbons (HC), carbon monoxide (CO), NOx, soot, and unburned or partially burned fuel. Lubricating oil in the crankcase tends to be atomized or otherwise entrained in the hot blow-by gases to form what may be termed an aerosol.

Blow-by gases in the crankcase, including entrained lubricating oil, are typically filtered or otherwise treated to remove oil before being provided back to the air intake system of the engine, or to the environment. Other systems direct the crankcase emissions into the engine exhaust system where they receive emission treatment to the same extent engine exhaust gases receive treatment before release to the environment. Those systems where the crankcase emissions are reintroduced into the engine for burning belong to the class of closed crankcase ventilation (CCV) systems, while systems in which crankcase emissions are processed and released to the environment are generally referred to as open crankcase ventilation (OCV) systems.

Some engines, such as large diesel engines, for example, utilize forced induction to enhance the power output of the engine. This may involve superchargers or turbochargers. Returning crankcase emissions to the intake side of a compressor in a supercharger or turbocharger can result in fouling of the compressor wheel in a relatively short time period. The fouling is compounded in multiple turbocharger systems as the heat increases in downstream compressor units. Additionally, cooling units downstream of a supercharger or turbocharger may be fouled. Therefore, crankcase emissions are typically purified before being returned to the intake in a supercharged or turbocharged engine.

A crankcase ventilation system is disclosed in U.S. Patent Application Pub. No. 2014/0290634A1 to Slaughter et al. ("Slaughter"). Slaughter describes A crankcase ventilation system for an internal combustion engine having a cylinder block that at least partially defines at least one cylinder, and includes a valve cover configured to be mounted on an individual cylinder head corresponding to an individual cylinder and form a cavity therein. A crankcase ventilation opening is associated with the valve cover, and a crankcase breather is incorporated into the valve cover.

SUMMARY

The disclosure describes, in one aspect, an internal combustion engine. The internal combustion engine includes a crankcase having a first plurality of openings and a second plurality of openings, the first plurality of openings being aligned with one another along a length of the crankcase at a first height, and the second plurality of openings being aligned with one another along the length of the crankcase at a second height. An oil pan is connected to a bottom portion of the crankcase. A first oil separation module has at least one first inlet housing, the at least one first inlet housing being fluidly connected to a first conduit, and a first oil separation filter disposed in fluid connection between the conduit and the oil pan. The at least one first inlet housing is connectable to an opening from the first plurality of openings or from the second plurality of openings such that a fluid circuit for venting gases present in the crankcase is defined from an internal cavity of the crankcase, to the at least one first inlet housing, to the first conduit, and through the first oil separation filter.

In another aspect, the disclosure describes a crankcase ventilation system for an internal combustion engine having a crankcase defining an internal cavity. The crankcase has a first plurality of openings and a second plurality of openings. The first plurality of openings is aligned with one another along a length of the crankcase at a first height, and the second plurality of openings is aligned with one another along the length of the crankcase at a second height. The internal combustion engine further includes an oil pan connected to a bottom portion of the crankcase. The crankcase ventilation system includes a first oil separation module having two first inlet housings, each of the two first inlet housings being fluidly connected to a first conduit, and a first oil separation filter disposed in fluid connection between the conduit and the oil pan. The two first inlet housings are selectively connectable to two adjacent openings from the first plurality of openings or from the second plurality of openings such that a fluid circuit for venting gases present in the crankcase is defined from an internal cavity of the crankcase, to the two first inlet housings, to the first conduit, and through the first oil separation filter.

The crankcase ventilation system further includes a second oil separation module having two second inlet housings, each of the two second inlet housings being fluidly connected to a second conduit, and a second oil separation filter disposed in fluid connection between the second conduit and the oil pan. The two second inlet housings are connectable to two other adjacent openings from the first plurality of openings or from the second plurality of openings such that an additional fluid circuit for venting gases present in the crankcase is defined from an internal cavity of the crankcase, to the two second inlet housings, to the second conduit, and through the second oil separation filter.

In yet another aspect, the disclosure describes a method for venting gases from an engine crankcase during operation. The method includes providing a crankcase having a first plurality of openings and a second plurality of openings formed along a cylinder bank, the first plurality of openings being aligned with one another along a length of the crankcase at a first height, and the second plurality of openings being aligned with one another along the length of the crankcase at a second height, the crankcase having an oil pan connected to a bottom portion of the crankcase. The method further includes providing a first oil separation module having two first inlet housings, each of the two first inlet housings being fluidly connected to a first conduit, and a first oil separation filter disposed in fluid connection between the conduit and the oil pan, and connecting the two first inlet housings to two adjacent openings from the first plurality of openings or from the second plurality of openings such that a fluid circuit for venting gases present in the crankcase is defined from an internal cavity of the crankcase, to the two first inlet housings, to the first conduit, and through the first oil separation filter.

In one embodiment, when the cylinder bank has X number of cylinders, the first oil separation module is connectable to the engine at a number of locations that is equal to (X−1) possible positions with respect to the crankcase and with respect to each of the first plurality of openings and the second plurality of openings. Accordingly, the method may also include selecting a possible position for the first oil separation from between the first and second pluralities of openings from (2X−2) total positions such that the first oil separation does not interfere with surrounding engine structures.

DETAILED DESCRIPTION

This disclosure relates to a crankcase ventilation (CV) system and method for an internal combustion engine. The CV system includes devices that are modular and can be replicated, on a single engine, to selectively adjust the CV capacity of the engine based on an engine structural configuration, power rating and the like. The CV system in accordance with the disclosure may be mounted onto various portions of the engine that are fluidly communicating with an internal cavity of the crankcase of the engine such that effective removal of CV gases may be efficiently removed from the engine during operation. In the embodiments illustrated herein, the described structures advantageously integrate a high blow-by flow capacity CV, oil separation module or "breather" into a structural valve cover and/or directly onto the crankcase of the engine. The CV or oil separation device supports a downstream high efficiency oil mist separator, if applicable. Given that the valve cover integrated oil separation module is associated with a unit cylinder head or, alternatively, an oil separation module associated with onto openings in the cylinder head and/or directly onto the crankcase, the resulting crankcase ventilation module can float, or be located forward or backward along the length of the engine as needed, or upwards or downwards on the crankcase between a top of the crankcase and an interface with an oil pan of the engine, and can readily be located on the left, right, top, bottom, and/or either or both sides of the engine. The modular approach also enables incremental blow-by flow capacity by adding additional crankcase ventilation modules to an engine configuration. This system can be also be adapted to other unit cylinder based engine platforms by simply creating one new valve cover base component. By standardizing component-to-component interface geometries, including existing mounting patterns on the front of the valve cover integrated breather, common components such as hoses, mounting brackets, high efficiency oil mist separators, heaters, insulators become possible between engine platforms.

Figure 1:
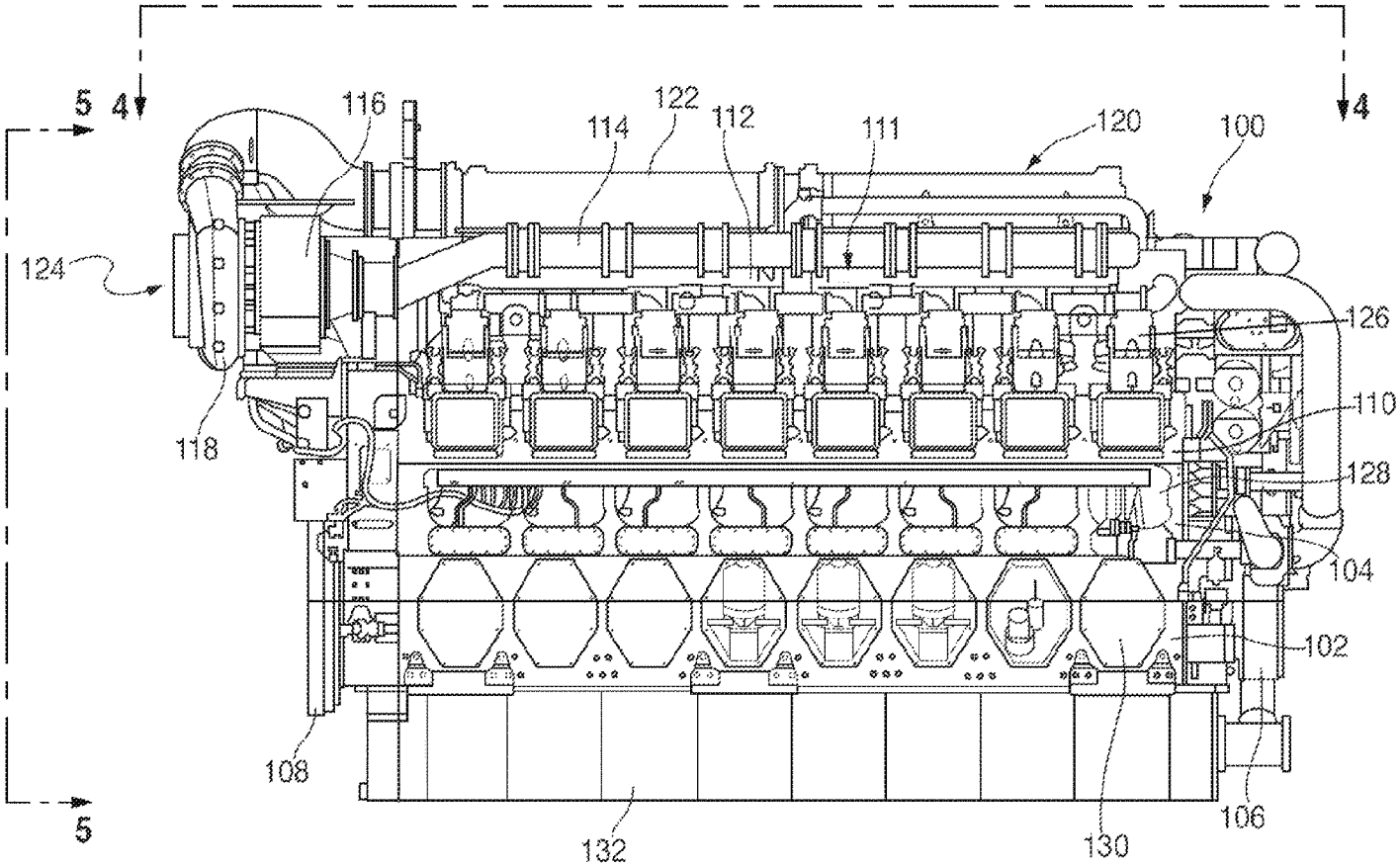
FIG. 1 is a block diagram of an internal combustion engine in accordance with the disclosure.

An outline view of an engine 100 is shown from a side perspective in FIG. 1. The engine 100 shown has a V-configuration, as is known, but the present disclosure is applicable to other engine types such as engines having an "I" or, stated differently, an inline configuration. Moreover, while the engine 100 is shown to have a total of sixteen cylinders (eight cylinders per bank), engines having fewer or more cylinders are also suitable for the benefits of the present disclosure. The engine 100 includes a crankcase 102 that houses a crankshaft (not shown). The crankshaft is connected to a plurality of pistons (not shown) via connecting rods (not shown). The pistons are slidably and reciprocally disposed in bores (not shown) formed in a cylinder case 104, which may be integrated into a single structure with the crankcase 102, and power the crankshaft to provide a useful mechanical working motion to a flywheel 108 and front balancer 106 of the engine 100, in the known fashion. A cylinder head 110 covers the top, open ends of the bores housing the pistons to form a plurality of power cylinders 111 of the engine 100. Eight power cylinders 111 are visible on the engine 100 from the perspective illustrated in FIG. 1.

The cylinder head 110 includes valves for providing fuel and air to the cylinders, and also for removing exhaust gases and other byproducts from the cylinders during operation, in the customary fashion. Air is provided to the cylinders via an intake manifold 112, and exhaust gases are collected from the various engine cylinders in an exhaust collector 114. As shown, the exhaust collector 114 is connected to a turbine 116, which operates to power a compressor 118. The compressor 118 is part of an intake system 120 of the engine 100, which may further include an intake air cooler 122. During engine operation, the compressor 118 admits air from an inlet 124, and compresses the air before providing it to the cylinders through the intake air cooler 122 and the intake manifold 112.

For covering the activation mechanisms operating the various intake and exhaust valves for each power cylinder 111, the engine 100 includes a valve cover 126 disposed to cover each cylinder in each power cylinder 111 set. Alternatively, a single valve cover may cover all cylinders in an engine bank, or all engine cylinders in an inline engine configuration. The engine crankcase 102 further forms additional openings, each of which may be sealably covered by a cover or plate. In the illustrated embodiment, the crankcase 102 forms a plurality of cam openings, each of which is closed by a cam cover 128, which is plate-shaped and sealably and releasably engages an area of the crankcase 102 around the respective cam opening to permit access for inspection of the cam lobes corresponding to a particular power cylinder 111, for example, during service, when the cam cover 128 is removed.

Similarly, the crankcase 102 forms a plurality of crankshaft openings, each of which is closed by a crank cover 130, which is plate-shaped and sealably and releasably engages an area of the crankcase 102 around the respective crank opening to permit access for inspection of the crank bearing and connecting rod corresponding to a particular power cylinder 111, for example, during service, when the crank cover 130 is removed. The crankcase 102 may form additional openings that are covered by removable covers for inspection and other reasons.

At a lower portion of the engine 100, an oil pan 132 covers a bottom portion of the crankcase 102 to sealably enclose the internal volume of the crankcase 102. The oil pan 132 defines a cavity that collects engine lubrication oil and acts as a sump in the known fashion.

The engine 100 may include oil separation or CV devices that fluidly interconnect the internal cavity of the crankcase 102 with a sink of CV gases produced by the engine during operation. These gases, which typically include exhaust gas constituents and engine lubrication droplets of various sizes suspended in aerosol form, are filtered to remove as much oil as possible before being released to the environment, being recirculated back into an air inlet of the engine, or mixed in with engine exhaust gases for treatment and abatement of certain exhaust gas constituents. In the case when gasses are released to the environment, the oil separation configuration is referred to as an open crankcase ventilation (OCV), while in the cases when the CV gasses are recirculated in the engine intake or exhaust, the oil separation configuration is referred to as a closed crankcase ventilation (CCV).

Figure 2:
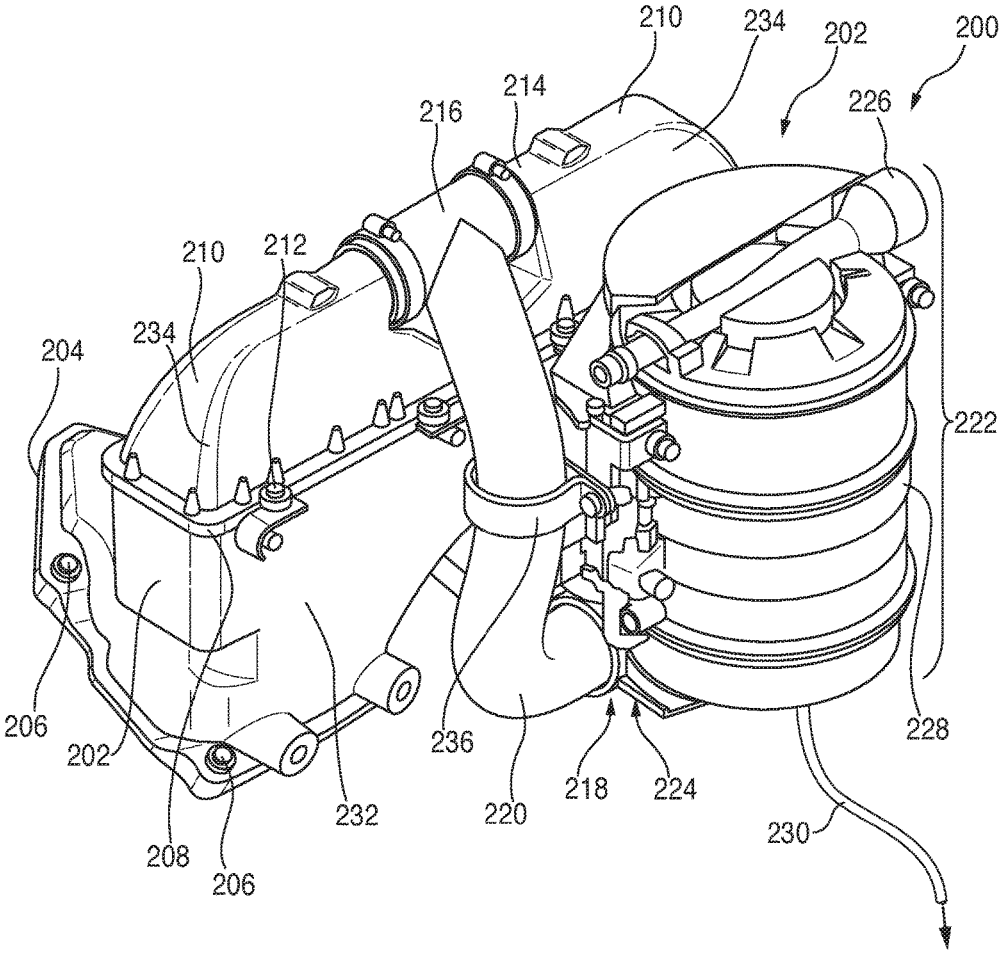
FIG. 2 is a perspective view of one embodiment of a CCV device in accordance with the disclosure.

In the present disclosure, two oil separation module embodiments are presented, which can be used either with an OCV or CCV oil separation configuration. In a first oil separation embodiment, a oil separation module 200 is configured to operate with and receive crankcase gasses through the engine valve covers 126. An outline view of the oil separation module 200 is shown in FIG. 2. The oil separation module 200 includes two inlet housings 202, each of which replaces a respective valve cover (e.g., 126, as shown in FIG. 1) and is connected to the engine 100 (FIG. 1) in place of two adjacent valve covers 126. Each inlet housing 202 includes a mounting flange 204 having a plurality of fasteners 206 that, when installed on an engine, engage an engine structure to mount the oil separation module 200 to the engine.

Each inlet housing 202 further forms an outlet flange 208 that surrounds an outlet opening. A cap 210 is connected to the outlet flange 208 and secured thereto by fasteners 212. A pattern for mounting the cap 210 to the respective outlet flange 208 may be symmetrical such that the same cap 210 can be used in mirror-image positions between the two inlet housings 202, as shown in FIG. 2. Each cap 210 forms an outlet bore 214 onto which an outlet conduit 216 can be connected. The outlet conduit 216, which is generally T-shaped or Y-shaped forms two inlet openings, each of which is fluidly connected with a respective outlet bore 214, and an outlet opening 218 that is formed at the end of an elongate conduit 220.

During operation, gases escaping through piston seals may collect within the crankcase cavity, which is otherwise sealed. These gases may waft up to the area surrounding the cylinder valves and occupy the space within the valve covers of the engine. Gases reaching the inlet housings 202, which are hollow, are allowed to pass through the inlet housings due to a pressure difference that is created between a relatively higher pressure in the crankcase and a relatively lower pressure at the oil separation module outlet 226. More specifically, gases that are generated and collect within the crankcase cavity during engine operation tend to increase a pressure within the crankcase cavity. By supplying CV gasses to a low pressure region such as an engine air inlet, a pressure difference is created across the oil separation module 200 tending to urge gases to pass there through from the oil separation module inlet 224 and the oil separation module outlet 226.

In the embodiment shown, the oil separation module structure 222 has a oil separation module inlet 224 and a oil separation module outlet 226. The oil separation structure 222 is disposed to receive and process gasses provided through the elongate conduit 220, which is connected via clamp 236, from the internal cavity of the crankcase during engine operation. The oil separation module structure 222, which can assume any known configuration, includes an oil separator or filter 228 that is fluidly disposed between the oil separation module inlet 224 and the oil separation module outlet 226 and configured to remove oil droplets entrained in a stream of crankcase gasses collected by the oil separation module to provide a filtered gas stream through the oil separation module outlet 226. Oil condensing or precipitating from the gas stream is removed via an oil return conduit 230 back to the engine.

During operation, a flow path for crankcase gasses is defined through the oil separation module 200. Gas enters the oil separation module 200 via openings defined within the mounting flanges 204. The gasses pass through an internal, hollow volume defined within the body 232 of each housing 202, and transition into an internal, hollow volume defined within the body 234 of each cap 210. The caps are funnel-shaped to route gases passing there through into their respective outlet bore 214. The gases thus enter the elongate conduit 220 and pass through the filter 228 before being provided either to a closed- or open-gas sink via the oil separation module outlet 226, which can include releasing the gases to the environment, recirculating the gases into the intake of the engine, mixing the gases with engine exhaust gases, and the like as described above.

Figure 3:
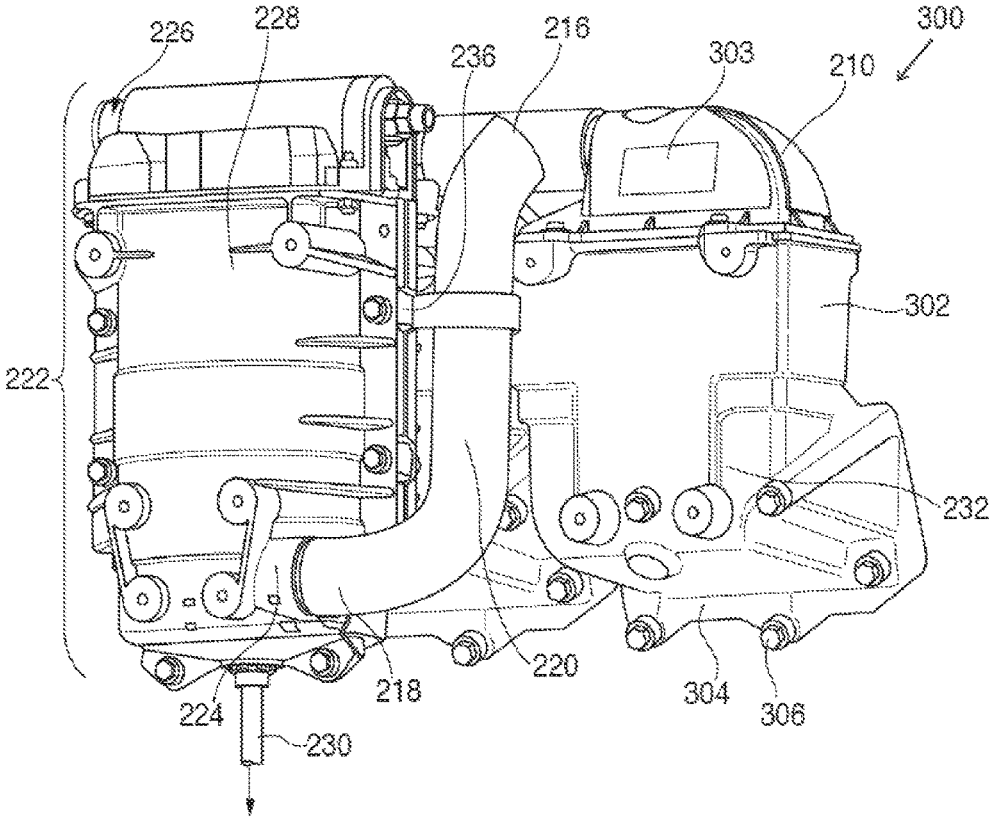
FIG. 3 is a perspective view of another embodiment of a CCV device in accordance with the disclosure.

An alternative embodiment for a oil separation module 300 is shown in FIG. 3. For simplicity, structures and features of the oil separation module 300 that are the same or similar to corresponding structures and features of the oil separation module 200 described above and shown in FIG. 2 are denoted by the same reference numerals as previously used. The oil separation module 300 differs from the oil separation module 200 (FIG. 2) primarily with respect to its mounting position on the engine 100. More specifically, while the oil separation module 200 is configured to be mounted in place of two adjacent valve covers 126 on the engine 100, the oil separation module 300 is configured to be mounted in place of two adjacent cam covers 128 (see FIG. 1) on the side of the crankcase 102. The oil separation module 300 is otherwise functionally identical to the oil separation module 200 and uses many parts in common or interchangeably with the oil separation module 200.

As shown in FIG. 3, the oil separation module 300 includes two inlet housings 302, each of which replaces a respective cam cover 128 (FIG. 1) and is thus connected to the engine 100 (FIG. 1) Each inlet housing 302 includes a mounting flange 304 having a plurality of fasteners 306 that, when installed on an engine, engage an engine structure to mount the oil separation module 300 to the engine.

The cap 210 in this embodiment, which is also applicable to the oil separation module 200, includes a heater 303. The heater 303, which may be an electrical heating element, operates to heat CV gases passing through the cap 210 during engine operation, and to generally decrease the viscosity of oil that may coagulate before or within the oil separation module to facilitate its draining from the filter 228 by gravity back into the engine 100 through the drain line 230. Moreover, the heater helps maintain CV gases above their dew temperature.

INDUSTRIAL APPLICABILITY

The present disclosure is applicable to internal combustion engines and, particularly, to CV systems for internal combustion engines. The disclosure provides a floating crankcase ventilation system. In the context of the disclosure, "floating" refers to the ability to mount one or more oil separation modules on an engine at various locations towards the front, back, either side, top, middle or bottom of the engine, or multiple engine types, depending on the packaging envelope around the engine that is available for various engine applications. Moreover, the modularity and interchangeability of engine mounting structures for oil separation modules provides the flexibility to install more than one oil separation module in parallel circuit configuration on an engine to increase the engine crankcase's breathing capacity selectively based on application.

Figure 5:
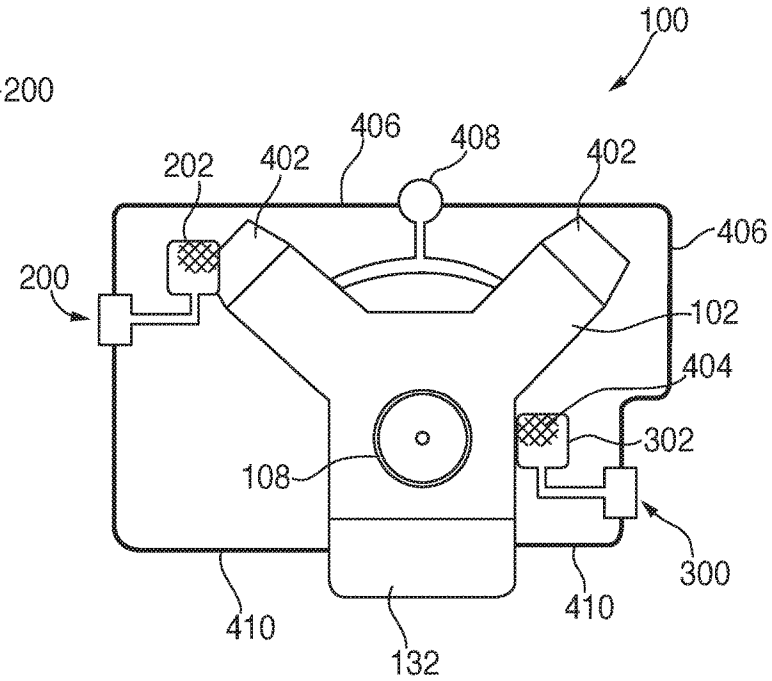
FIGS. 4 and 5 are block diagrams of an engine from top and front perspectives, respectively, in accordance with the disclosure.
Figure 4:
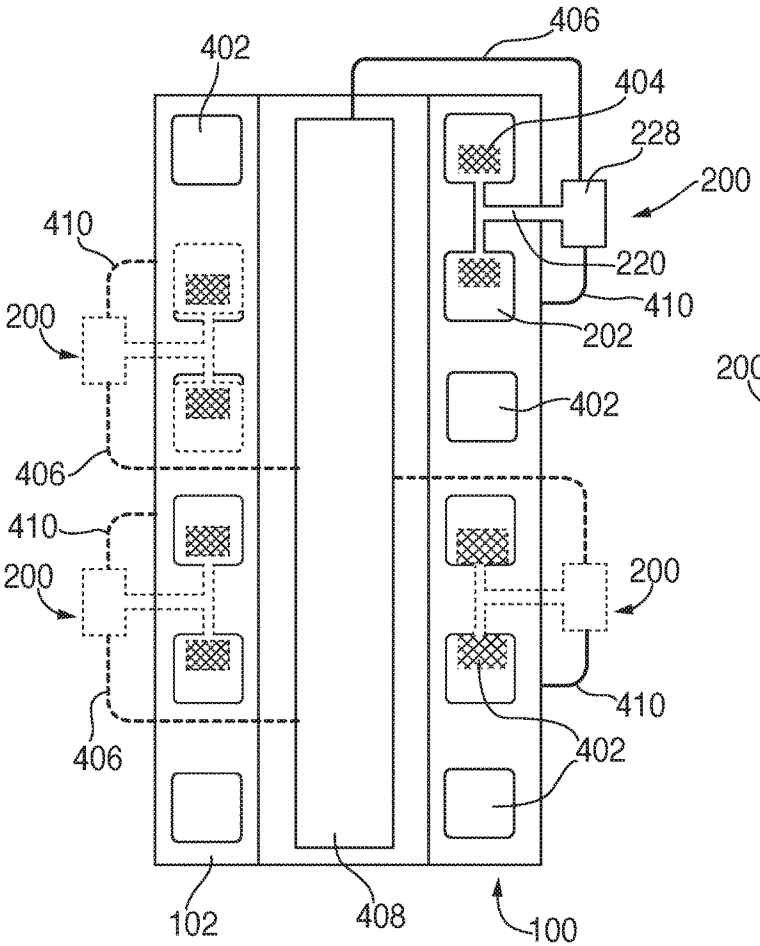

Diagrammatic views showing multiple oil separation module placements on the engine 100 are shown in FIGS. 4 and 5. FIG. 4 shows a top view of the engine 100, where the various valve cover locations 402 are represented, and FIG. 5 shows a front view of the engine 100 to illustrate placement of oil separation modules on the engine at various heights. More specifically, and in reference to FIGS. 4 and 5, a oil separation module 200 is shown connected to a top, right position on the engine 100 in FIG. 4. The oil separation module 200 occupies two valve cover locations 402, onto which the inlet housings 202 are connected. As shown here, each inlet housing 202 includes a screen 404 that helps collect larger oil droplets entering the oil separation module 200. The screen 404 may be embodied in any known fashion including, but not limited to, baffles, perforated plates, expanded metal media and other structures. The inlet housings 202 are connected to the conduit 220, which provides gases to the filter 228. From the filter, a gas line 406 provides filtered gas to the engine intake system 408, shown schematically, through, for example, the compressor inlet 124 (FIG. 1), and a drain line 410 routes liquid oil removed or separated from the breather gas to the oil pan 132. As shown using dashed lines, the oil separation module 200 may assume any position on the engine 100 by occupying adjacent valve cover locations 402, and more than one oil separation module can be connected to the engine in parallel circuit connection, i.e., having each oil separation module inlet in fluid communication with an internal cavity of the crankcase, and having each oil separation module outlet in fluid communication with a common fluid sink such as the compressor inlet of the engine for an exemplary CCV-type oil separation module, or another fluid sink.

As can be seen from the front view of the engine, in FIG. 5, a oil separation module 300 is connected to a side of the crankcase 102 at a location that is lower than the oil separation module 200, also shown in FIG. 5. The oil separation module 300 occupies two cam cover 128 locations (as shown in FIG. 1 from a side perspective), onto which the inlet housing 302 (only one housing is visible) are connected. As shown here, each inlet housing 302 includes a screen 404 that helps collect larger oil droplets entering the oil separation module 300. The inlet housings 302 are connected to the conduit 220, which provides gases to the filter 228. From the filter, a gas line 406 provides filtered gas to the engine intake system 408, shown schematically, and a drain line 410 routes liquid oil removed or separated from the CV gas to the oil pan 132. As with the oil separation module 200, the oil separation module 300 can be located anywhere along the engine 100 by occupying adjacent cam cover 128 locations, and more than one oil separation module can be connected to the engine in parallel circuit connection, i.e., having each oil separation module inlet in fluid communication with an internal cavity of the crankcase, and having each oil separation module outlet in fluid communication with a common fluid sink such as the compressor inlet of the engine for an exemplary CCV-type oil separation system, or another fluid sink.

When viewing the arrangement of FIG. 4, where the engine have twelve cylinders, arranged in two banks of six cylinders, it can be seen that the oil separation module 200 may assume any one of five possible positions along each engine bank. Thus, in general, for an engine having X cylinders arranged along a cylinder bank, the oil separation module can assume any one of (X−1) positions along the cylinder bank for each of the valve cover and the cam cover openings. In the engine 100 as shown in FIGS. 4 and 5, for example, where each bank has six cylinders, then there are two sets of five possible positions, or (2X−2) possible positions, where X=6, for a total of 10 possible positions for mounting a oil separation module 200 or a oil separation module 300. When both sides of the engine are considered, there are twenty possible oil separation module mounting locations, which provides great flexibility in engine packaging design. In addition, it is contemplated that a single inlet housing occupying a single mounting location to the engine may be used. In such case, there will be X possible locations along the engine for mounting an oil mist separation module for each plurality of openings, for a total of 2X possible locations in the exemplary engine embodiments illustrated here.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. An internal combustion engine, comprising:

a crankcase having a first plurality of openings and a second plurality of openings, the first plurality of openings being aligned with one another along a length of the crankcase at a first height, and the second plurality of openings being aligned with one another along the length of the crankcase at a second height, an oil pan connected to a bottom portion of the crankcase;

a first oil separation module having at least one first inlet housing, the at least one first inlet housing being fluidly connected to a first conduit, and a first oil separation filter disposed in fluid connection between the first conduit and the oil pan;

wherein the at least one first inlet housing is connectable to an opening from the first plurality of openings or from the second plurality of openings such that a fluid circuit for venting gases present in the crankcase is defined from an internal cavity of the crankcase, to the at least one first inlet housing, to the first conduit, and through the first oil separation filter.

2. The internal combustion engine of claim 1, further comprising a second oil separation module having two second inlet housings, each of the two second inlet housings being fluidly connected to a second conduit, and a second oil separation filter disposed in fluid connection between the second conduit and the oil pan, wherein the two second inlet housings are connectable to two other adjacent openings from the first plurality of openings or from the second plurality of openings such that an additional fluid circuit for venting gases present in the crankcase is defined from the internal cavity of the crankcase, to the two second inlet housings, to the second conduit, and through the second oil separation filter.

3. The internal combustion engine of claim 1, wherein the at least one first inlet housing further includes a heater.

4. The internal combustion engine of claim 1, wherein the at least one first inlet housing further includes a screen.

5. The internal combustion engine of claim 1, wherein each of the first plurality of openings is associated with a valve activation mechanism for a power cylinder of the internal combustion engine.

6. The internal combustion engine of claim 5, further comprising a valve cover fluidly isolating each of the first plurality of openings from an environment external to the internal cavity of the crankcase.

7. The internal combustion engine of claim 1, wherein the first oil separation module includes two first inlet housings, wherein the two first inlet housings are connectable to two adjacent openings from the first plurality of openings or from the second plurality of openings, and wherein the fluid circuit includes each of the two first inlet housings disposed in parallel circuit arrangement between the internal cavity of the crankcase and the first conduit.

8. The internal combustion engine of claim 7, further comprising a cam cover covering each of the second plurality of openings.

9. A crankcase ventilation system for an internal combustion engine having a crankcase defining an internal cavity, the crankcase having a first plurality of openings and a second plurality of openings, the first plurality of openings being aligned with one another along a length of the crankcase at a first height, and the second plurality of openings being aligned with one another along the length of the crankcase at a second height, the internal combustion engine further including an oil pan connected to a bottom portion of the crankcase, the crankcase ventilation system comprising:

a first oil separation module having two first inlet housings, each of the two first inlet housings being fluidly connected to a first conduit, and a first oil separation filter disposed in fluid connection between the first conduit and the oil pan;

wherein the two first inlet housings are selectively connectable to two adjacent openings from the first plurality of openings or from the second plurality of openings such that a fluid circuit for venting gases present in the crankcase is defined from the internal cavity of the crankcase, to the two first inlet housings, to the first conduit, and through the first oil separation filter; and a second oil separation module having two second inlet housings, each of the two second inlet housings being fluidly connected to a second conduit, and a second oil separation filter disposed in fluid connection between the second conduit and the oil pan;

wherein the two second inlet housings are connectable to two other adjacent openings from the first plurality of openings or from the second plurality of openings such that an additional fluid circuit for venting gases present in the crankcase is defined from the internal cavity of the crankcase, to the two second inlet housings, to the second conduit, and through the second oil separation filter.

10. The crankcase ventilation system of claim 9, wherein at least one of the two first inlet housings further includes a heater.

11. The crankcase ventilation system of claim 9, wherein at least one of the two second inlet housings further includes a heater.

12. The crankcase ventilation system of claim 9, wherein each of the two first inlet housings further includes a screen.

13. The crankcase ventilation system of claim 9, wherein each of the two second inlet housings further includes a screen.

14. The crankcase ventilation system of claim 9, wherein each of the first plurality of openings is associated with a valve activation mechanism for a power cylinder of the internal combustion engine.

15. The crankcase ventilation system of claim 14, further comprising a valve cover fluidly isolating each of the first plurality of openings from an environment external to the internal cavity of the crankcase.

16. The crankcase ventilation system of claim 9, wherein each of the second plurality of openings is formed along a side of the crankcase to provide access to an engine camshaft for service.

17. The crankcase ventilation system of claim 16, further comprising a cam cover covering each of the second plurality of openings.

18. A method for venting gases from an engine crankcase during operation, comprising:

providing a crankcase having a first plurality of openings and a second plurality of openings formed along a cylinder bank, the first plurality of openings being aligned with one another along a length of the crankcase at a first height, and the second plurality of openings being aligned with one another along the length of the crankcase at a second height, the crankcase having an oil pan connected to a bottom portion of the crankcase;

providing a first oil separation module having two first inlet housings, each of the two first inlet housings being fluidly connected to a first conduit, and a first oil separation filter disposed in fluid connection between the first conduit and the oil pan;

connecting the two first inlet housings to two adjacent openings from the first plurality of openings or from the second plurality of openings such that a fluid circuit for venting gases present in the crankcase is defined from an internal cavity of the crankcase, to the two first inlet housings, to the first conduit, and through the first oil separation filter;

wherein when the cylinder bank has X number of cylinders, the first oil separation module is connectable to the engine at a number of locations that is equal to (X−1) possible positions with respect to the crankcase and with respect to each of the first plurality of openings and the second plurality of openings; and wherein a possible position for the first oil separation module is selected as between the first and second pluralities of openings from (2X−2) total positions such that the first oil separation module does not interfere with surrounding engine structures.

19. The method of claim 18, further comprising:

providing a second oil separation module having two second inlet housings, each of the two second inlet housings being fluidly connected to a second conduit, and a second oil separation filter disposed in fluid connection between the second conduit and the oil pan; and connecting the two second inlet housings to another two adjacent openings from the first plurality of openings or from the second plurality of openings such that a second fluid circuit for venting gases present in the crankcase is defined from the internal cavity of the crankcase, to the two second inlet housings, to the second conduit, and through the second oil separation filter.

20. The method of claim 18, further comprising heating a gas passing through at least one of the two first inlet housings.

* * * * *